US005653225A

United States Patent [19]

Schegerin

[11] Patent Number: 5,653,225

[45] Date of Patent: Aug. 5, 1997

[54] INDIVIDUAL PROTECTIVE AND BREATHING EQUIPMENT FOR CONTAMINATED ENVIRONMENTS

[75] Inventor: Robert Schegerin, Jouy en Josas, France

[73] Assignee: Intertechnique, France

[21] Appl. No.: 157,110

[22] PCT Filed: Jan. 29, 1993

[86] PCT No.: PCT/FR93/00100

§ 371 Date: May 23, 1994

§ 102(e) Date: May 23, 1994

[87] PCT Pub. No.: WO93/14818

PCT Pub. Date: Aug. 5, 1993

[30] Foreign Application Priority Data

Jan. 30, 1992 [FR] France ..... 92 01017

[51] Int. Cl.[6] ..... A62B 17/00

[52] U.S. Cl. ..... 128/201.24; 128/201.22; 128/201.23; 128/201.25; 128/206.21; 128/206.23

[58] Field of Search ..... 128/201.22, 201.29, 128/204.15, 206.27, 207.17, 207.11, 202.11, 206.23, 206.24; 2/2.15, 410, 424, 427, 428, 171.2, 173, 202, 205.9

[56] References Cited

U.S. PATENT DOCUMENTS

| | | | |
|---|---|---|---|
| H000883 | 2/1991 | Little et al. | 128/201.22 |
| 1,077,272 | 11/1913 | Graybill et al. | 128/206.24 |
| 2,390,233 | 12/1945 | Akerman et al. | 128/202.11 |
| 3,680,555 | 8/1972 | Warncke | 128/206.24 |
| 3,971,368 | 7/1976 | Forbes et al. | 128/201.15 |
| 4,315,335 | 2/1982 | Kennedy, Jr. et al. | 128/206.24 |
| 4,352,353 | 10/1982 | Bolton et al. | 128/201.24 |
| 4,404,969 | 9/1983 | Cresswell et al. | 128/201.23 |
| 4,764,990 | 8/1988 | Markert | 128/206.24 |
| 5,003,632 | 4/1991 | Claude | 128/202.27 |
| 5,245,993 | 9/1993 | McGrady et al. | 128/202.11 |

FOREIGN PATENT DOCUMENTS

| | | | |
|---|---|---|---|
| 0371858 | 6/1990 | European Pat. Off. . | |
| 0511593 | 11/1992 | European Pat. Off. | 128/206.23 |
| 2109042 | 5/1972 | France . | |
| 2350851 | 12/1977 | France . | |
| 2629719 | 10/1989 | France . | |
| 3138697 | 4/1983 | Germany . | |
| 2148697 | 6/1985 | United Kingdom | 128/201.22 |
| 2203050 | 10/1988 | United Kingdom | 128/201.15 |

*Primary Examiner*—Aaron J. Lewis
*Assistant Examiner*—V. Srivastava
*Attorney, Agent, or Firm*—Larson and Taylor

[57] ABSTRACT

The equipment comprises a helmet (10) having a rigid shell and inside padding, a balaclava-like hood (26) for separating the head from the environment and designed to be worn directly on the skin, and a mouth-and-nose breathing mask (20) provided with a duct (22) for coupling to an external source of breathable gas, and provided with means (16) for fastening to the helmet. The hood comprises a web (28) in which at least one opening is formed for placing over the eyes of the wearer, and removable transparent goggles (30) provided with means for fastening to the hood and/or to the helmet in a position where the edges of the goggles bear in airtight manner against the web around the opening.

11 Claims, 5 Drawing Sheets

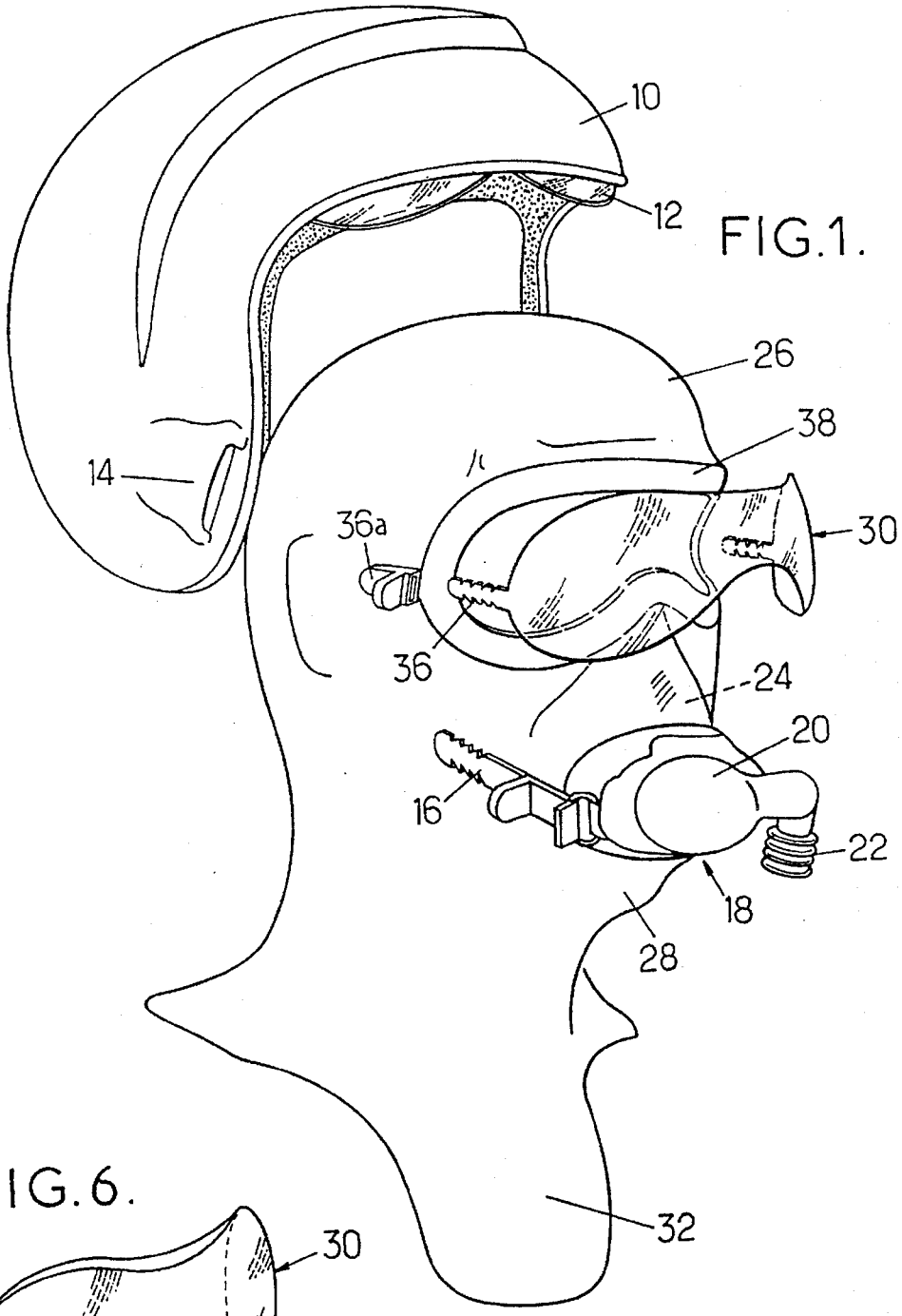
FIG.1.
FIG.6.
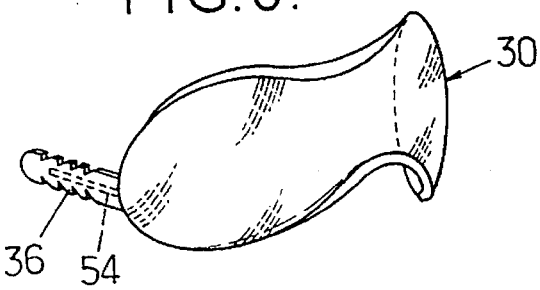

INDIVIDUAL PROTECTIVE AND BREATHING EQUIPMENT FOR CONTAMINATED ENVIRONMENTS

BACKGROUND OF THE INVENTION

The invention relates to individual protective equipment for an environment that might be subject to nuclear, biological, or chemical contamination, such equipment being said to provide NBC protection.

The invention relates more particularly to individual protective and breathing equipment comprising a helmet having a rigid shell and internal padding, a balaclava-like hood for separating the head from the environment and advantageously provided with ventilation air feed means, the hood being designed to be worn directly on the skin, and a mouth-and-nose face-mask for breathing provided with a duct for connection to an external source of breathable gas and with means for fastening to the helmet.

Various individual equipment sets as defined above are already in existence. In particular, such sets of equipment have been made for the crew members of aircraft that are capable of operating at high altitude, requiring the wearing of a breathing mask capable of being fed from an external source with a mixture that is enriched in oxygen or even with pure oxygen.

For reasons of comfort and of reducing fatigue, people should be required to wear a balaclava-like NBC protection hood only when performing missions where that might become necessary. Proposals have been made to use an inseparable assembly of such a hood fitted with a combined transparent visor and breathing mask (U.S. Pat. No. 4,404,969 and FR-A-2 350 851). It suffers from the severe drawback of requiring two distinct complete sets of equipment to be provided for each crew member.

One of the sources of discomfort in existing hoods that come directly into contact with the skin results from the fact that they are completely closed so that in order to wear a hood it is necessary also to wear a mask. The present invention seeks in particular to provide breathing equipment of the above type that eliminates or at least attenuates the discomfort.

SUMMARY OF THE INVENTION

To this end, the invention provides, in particular, equipment in which the hood comprises a web in which at least one opening is provided for placing over the eyes of the wearer, and removable transparent goggles provided with fastening means for fastening to the hood and/or to the helmet in a position where its edges bear in airtight manner against the web around the opening.

When the goggles are placed outside the web, as will most frequently be the case, they may be provided with means for fastening to the rigid shell of the helmet that may be similar in structure to the means for fastening the breathing mask to the helmet, except insofar as it is not necessary for them to have such a wide range of adjustment. These means may be pierced by a channel for feeding ventilation air and/or for extracting air so as to enable the inside surface of the goggles to be swept with de-misting air.

In another particular embodiment, that makes it easier to achieve sealing, the goggles are designed to be placed inside the web. Under such circumstances, inserting the visor through the opening and installing it properly are then more difficult than in the preceding case.

The use of a visor that is detachable already substantially improves the comfort of the wearer of the hood.

Nevertheless, it is particularly advantageous also to provide an opening through the web for the purpose of enabling a breathing mask to be inserted from the outside and to enable the mask to be applied in airtight manner against the face, without thereby compromising the sealing of the hood. This result can be achieved without major difficulty by using a hood web that is made of an elastic material such as neoprene, and that is provided around the mask-receiving opening with sealing means for pressing against the rigid shell that generally covers the front portion of the face-mask or that constitutes the face-mask.

The joint between the web and the mask may be made airtight, in particular by providing the web of the hood around the mask-receiving opening with sealing means such as a bead, a lip seal, or an inflatable seal for engaging in a circumferential groove provided in the shell of the mask.

By this disposition, the mask may merely be suspended from one of its straps so long as there is no risk of contamination (and when flying at low altitude if the equipment is for use in aircraft). In practice, this does not increase danger to the wearer since it is presently accepted that it will be possible to inform people of any risk of contamination in sufficient time to enable them to protect themselves by putting on the goggles and the mask (where applicable), whenever equipment of the present invention is in use.

The invention will be better understood on reading the following description of particular embodiments given as non-limiting examples.

BRIEF DESCRIPTION OF THE DRAWINGS

FIG. 1 is a diagrammatic, exploded view of the various components of a set of equipment constituting a particular embodiment of the invention;

FIG. 6 is a diagram showing goggles fitted with a de-misting duct.

DESCRIPTION OF A PREFERRED EMBODIMENT

Figure 2:
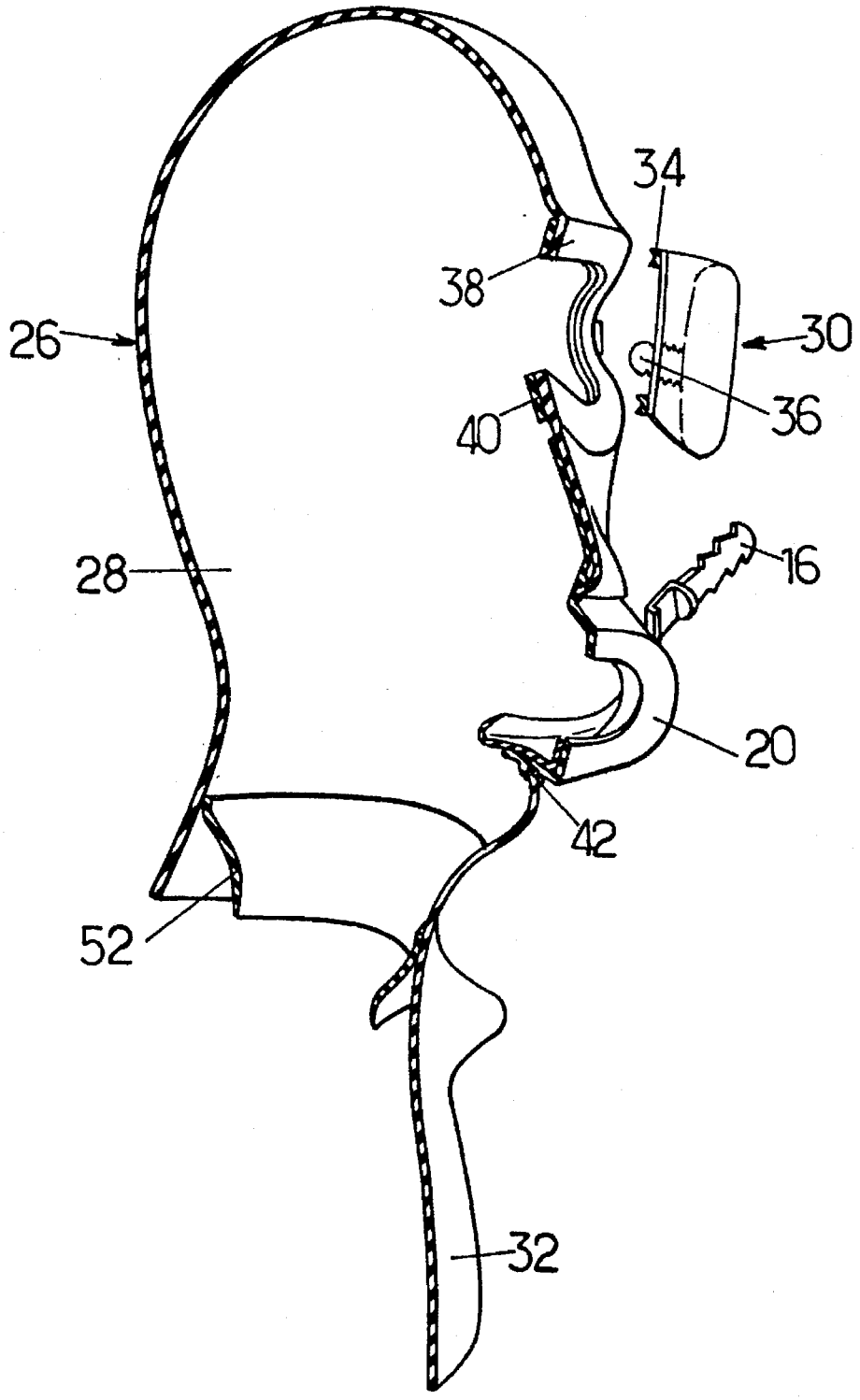
FIG. 2 is a perspective view of half of the FIG. 1 equipment, with the helmet being omitted.

In conventional manner, the breathing equipment shown diagrammatically in FIGS. 1 to 6 comprises a helmet 10 constituted by a shell and inside padding. The shell of the helmet 10 carries receptacles 14 for receiving fasteners 16 for fixing a breathing mask 18. In conventional manner, the mask comprises a rigid shell 20 carrying a duct 22 for connection to a pipe for feeding breathable gas, and a face-mask 24 having a sealing lip. The equipment also includes a balaclava-like hood 26 which may or may not be in use depending on the type of mission.

The fasteners may, in particular, be of the structure described in Document FR-A-88 04 616. When the equipment is in use, the feed pipe may be connected, for example, to a demand regulator, such as that described in Document EP-A-0 153 247.

The shell of the helmet 10 is made of a rigid molded material and may constitute any of the presently-known structures. It may be provided with one or more visors 12 movable between a retracted position as shown in FIG. 1 and a low position.

The hood 26 is designed to be worn directly on the head, beneath the helmet 10. The hood of the invention comprises firstly a web 28 of flexible and gastight material, and secondly goggles 30 designed to be removably fastened to the web and to close in airtight manner an opening provided through the web over the eyes of the wearer.

Depending on the embodiments selected, the hood may be made entirely of one material such as a vinyl derivative, which is flexible but not very stretchable, entirely of another material having a degree of elasticity, such as neoprene, or else it may be composite, i.e. it may be made up of a plurality of different materials in different places. Several sizes of hood may be provided to fit the morphology of different wearers. The web may have an inside collar folded upwards to constitute a neck seal. However, since the hood will often be worn together with other protective clothing, it may be sufficient merely to provide a bib 32 (FIG. 1).

In all of the embodiments shown by way of example, the web of the hood also includes an opening enabling the breathing mask 18 to be inserted from the outside and enabling the face-mask 24 to be pressed against the face around the nose and the mouth, said opening being of a size such that its edge subsequently bears against the shell 20 of the mask in airtight manner. The major portion of the shell 20 and the fixing means 16 remain outside the hood: the fasteners 16 which are constituted by bayonet-type fasteners in the example shown, can consequently be engaged without difficulty in the receptacles 14 provided on the shell of the helmet 10.

In order to make it possible simultaneously for the face-mask 24 to be capable of being inserted into the web and for there to be airtight contact after it has been inserted, at least that portion of the web that surrounds the opening must be made of a material that is elastic.

In general, regardless of the embodiment used, the portion of the web lying outside the helmet must be made of a material that is impermeable to contamination. In contrast, this condition is not necessary for the portion of the web that is covered by the helmet. Consequently, that portion may be made of a material whose contact with skin is easier on the wearer than elastomers or synthetic materials, for example it may be a textile.

Various particular embodiments of the invention are described below as examples.

In the embodiment shown in FIGS. 1 and 2, the goggles 30 are designed to be placed outside the web 28. The goggles are constituted by a flexible sheet of material that is transparent and impermeable, e.g. a polymethacrylate, carrying a seal 34 on its inside face and extended by two fasteners 36 that may be constituted by adjustable straps. The web 28 has a thick margin 38 defining the opening which is covered by the goggles and designed to constitute the sealing zone. It is often preferable to place reinforcement 40 beneath the margin 38 to provide local stiffening for the web so as to improve sealing, which reinforcement may additionally be of varying thickness so as to compensate for irregularities of the face. The straps may be designed to engage in receptacles (not shown) formed in the outside shell of the helmet. They may be replaced by tabs 36*a* designed to engage on anchor points molded in the web, in the space that remains empty around the head between the padding of the helmet and the periphery of the goggles 30. Finally, the two kinds of fastening may be combined, with engagement to the web ensuring proper positioning while the additional fastening to the shell of the helmet serves to withstand forces due to the inside of the hood being pressurized.

As can be seen in FIG. 2, the mask-receiving opening may be defined by a sealing bead 42 which snaps into a circumferential groove provided for this purpose in the shell of the face-mask. Such snap-fastening makes it possible to avoid loss of sealing by the edge of the opening being pushed back when the hood is pressurized.

Figure 3:
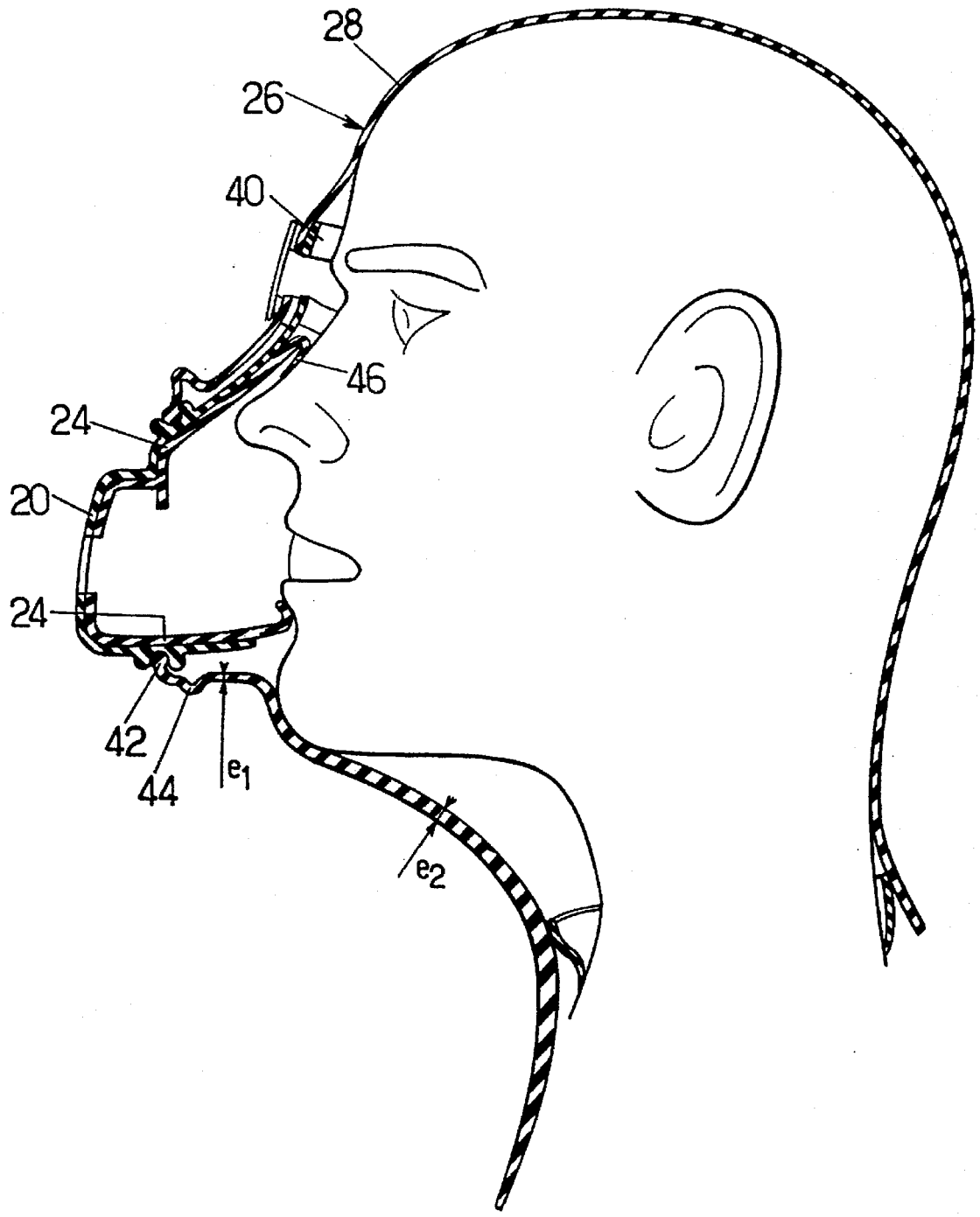
FIG. 3 is a section view on a median plane merely for showing the connections between the web of the hood and the goggles and between the web of the hood and the breathing mask.

The variant embodiment shown in FIG. 3 (where items corresponding to those of FIGS. 1 and 2 are designated by the same reference numerals) includes a web that has a fold 44 surrounding the edge of the mask-receiving opening. The portion of the web that includes the fold 44 is of thickness e1 that is smaller than the thickness e2 of the remainder of the web, thereby further increasing the additional flexibility given by the fold and improving the fit between the web and the shell 20. Several successive folds may be provided instead of only one. As shown in FIG. 3, contact airtightness of the face-mask may be achieved by a thin internal end fold 46 of the face-mask.

Figure 4:
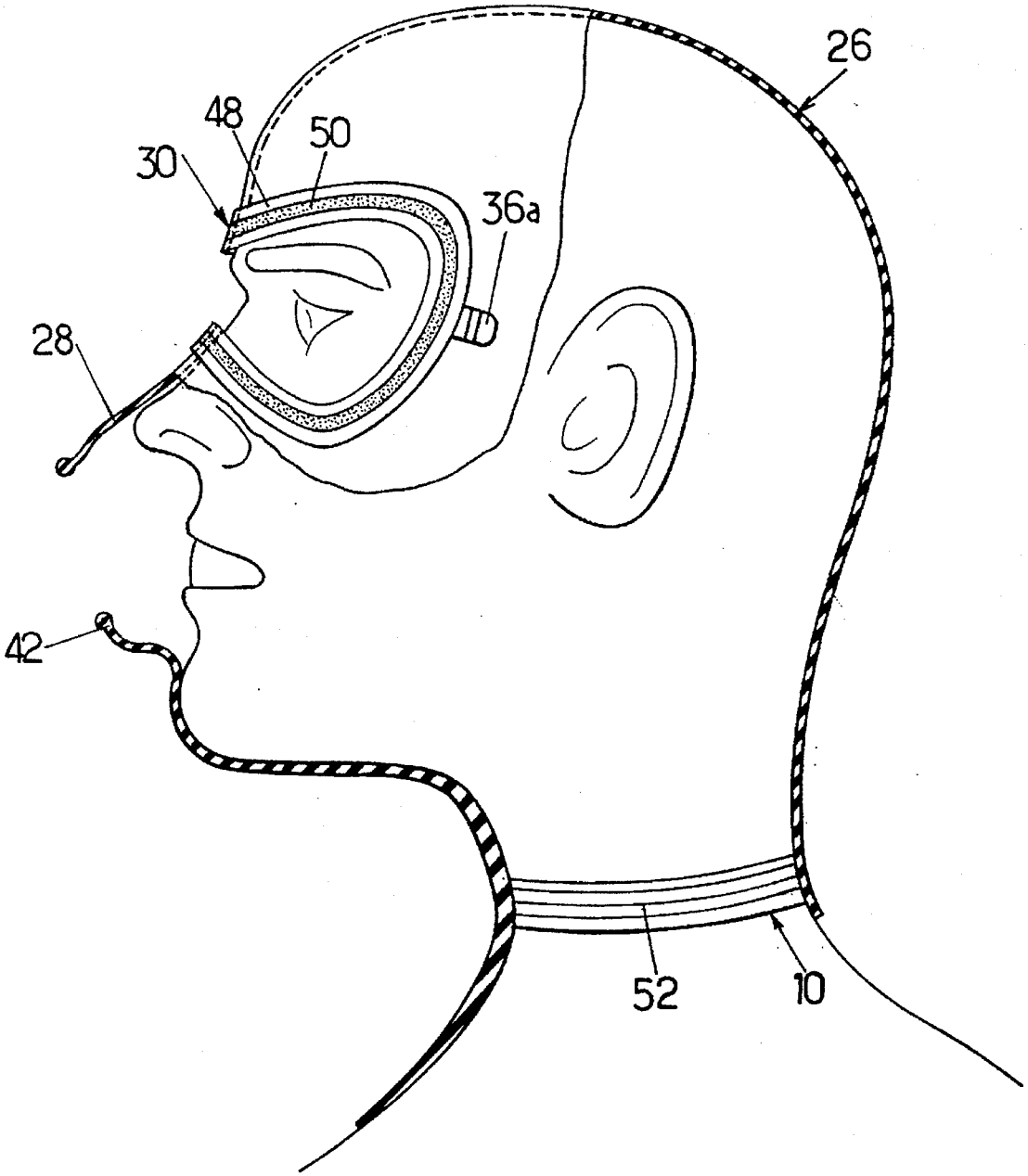
FIG. 4 is similar to FIG. 3, but shows the hood components only.

FIG. 4, where items that have already been shown are designated by the same reference numerals, shows a hood in which the goggles 30 are provided with a margin 48, e.g. of elastomer, carrying an inside seal 50 which may be constituted, in particular, by a lip seal or by an inflatable seal capable of being inflated by means described below. This margin may be extended by tabs for engaging, e.g. by snap-fastening, on thickenings provided on the web of the hood.

Like the web of FIG. 2, the web shown includes a neck seal 52.

Figure 5:
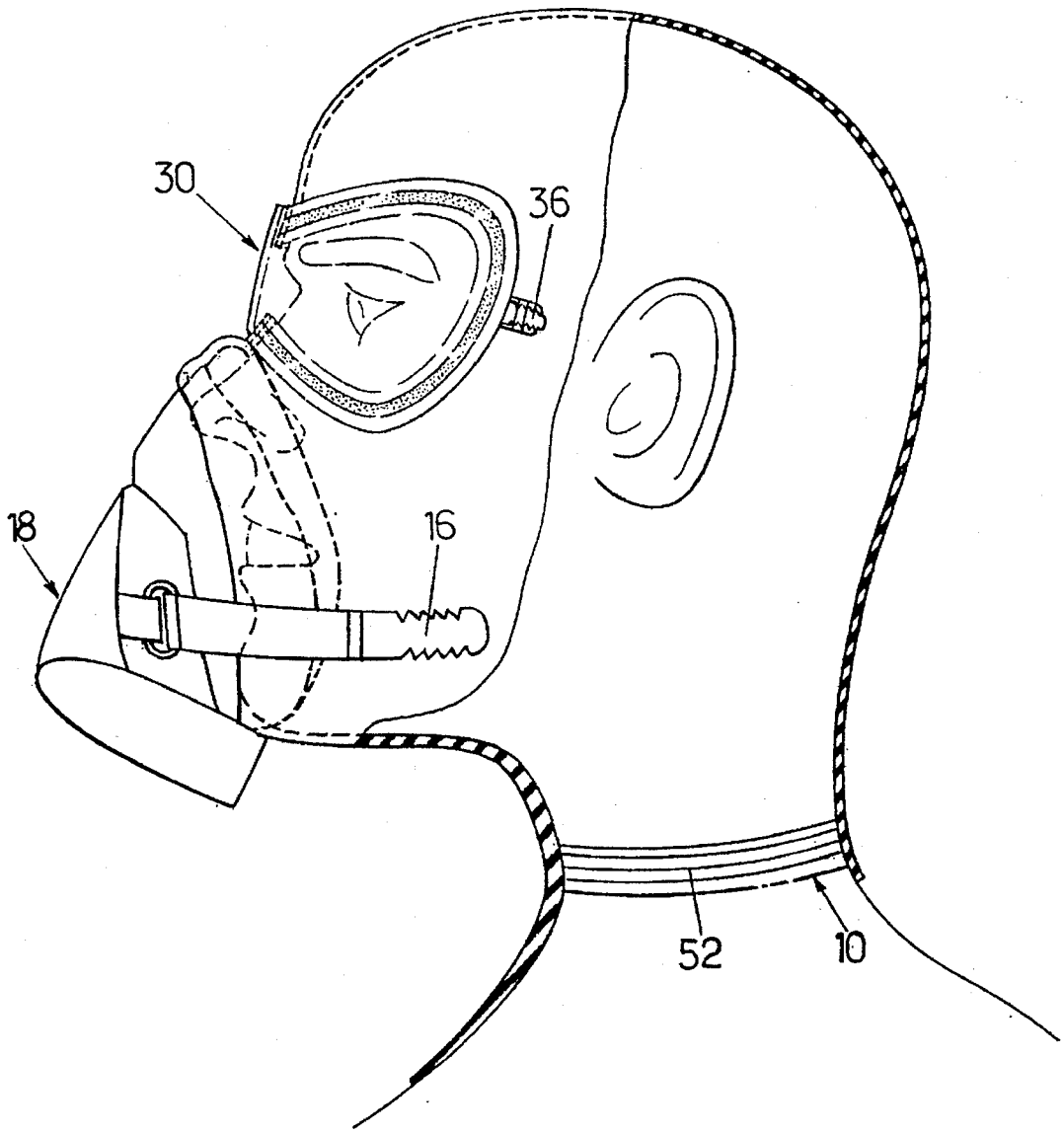
FIG. 5 is similar to FIG. 4 but shows fastening means suitable for fastening the mask and the goggles to the helmet.

FIG. 5 shows the hood and the mask of a set of equipment in which the goggles 30 and the mask 18 are both fixed to the helmet by means of adjustable straps enabling the pressure against the face to be adjusted and enabling them to be adapted to the morphology of the wearer. The use of such straps provides the advantage that the wearer can initially install the straps in a position that serves merely for connection purposes and need only tighten them fully to guarantee sealing in the event of danger, with it being possible to perform tightening using one hand only. Nevertheless, other fastening means can be used. For example, the goggles may be designed to fasten all round the opening while still being provided with straps or with tabs.

The use of adjustable straps 36 for fastening to the shell of the helmet makes it possible to establish a flow of de-misting and sweeping air through the goggles and/or to feed an inflatable seal. It is possible to provide an air feed channel 54 in one or the other of the straps. Air exhaust may take place through the inside of the hood. It is also possible for air to be exhausted via a channel provided in one of the straps. Air feed may be taken either from the feed regulator of the mask via a small diameter hose, or else from the feed for the anti-g valve if the protective equipment for a pilot includes such a valve.

Numerous other variant embodiments of the invention are possible. In particular one or more of the seals may be of the inflatable type and may be fed with air as soon as the demand regulator feeding the mask is put into operation. The fastening devices may be different from those shown by way of example. Finally, at least in the portion of the web that covers the hair, it is possible to provide internal fluting enabling air to flow and transpiration to be exhausted.

I claim:

1. Individual protective and breathing equipment comprising a helmet having a rigid shell and inside padding, a balaclava-like hood for separating a wearer's head from the environment, the hood being designed to be worn directly on the skin, and a mouth-and-nose face-mask for breathing provided with a duct for connection to an external source of breathable gas and with means for fastening to the helmet, wherein the hood comprises a web having a first opening for placing over the eyes of the wearer, the equipment further comprising transparent goggles removably fastenable over the first opening to be either sealed thereover in an airtight manner or manually removed therefrom to uncover the first opening, said goggles being provided with fastening means for fastening to the hood and/or to the helmet in such a position that the edges of said goggles bear in said airtight manner against the web around the said first opening and wherein said web has a second opening spaced from the first opening by a portion of the web for sealingly receiving the mouth-and-nose face-mask.

2. Equipment according to claim 1, wherein the goggles are placed outside the web and are provided with fastening means for fastening to the rigid shell of the helmet, which means are constituted by adjustable straps.

3. Equipment according to claim 2, wherein the fastening means of the goggles are pierced by a feed channel for de-misting air and optionally by an exhaust channel therefor.

4. Equipment according to claim 1, wherein the web of the hood is provided with sealing means around said second opening.

5. Equipment according to claim 4, wherein the sealing means engage in a circumferential groove provided on said ridge shell of the mask.

6. Equipment according to claim 1, wherein the web of the hood is made of a material that is impermeable to contamination solely in that portion of the hood which is situated outside the padding of the helmet.

7. Equipment according to claim 6, wherein the web is constituted, at least in the portion thereof situated outside the padding of the helmet, of a material that is elastically stretchable.

8. Equipment according to claim 7, wherein said elastically stretchable material is neoprene.

9. Equipment according to claim 4, wherein said sealing means comprise a bead.

10. Equipment according to claim 4, wherein said sealing means comprise a lip seal.

11. Equipment according to claim 4, wherein said sealing means comprise an inflatable seal.

* * * * *